US010791888B1

(12) United States Patent
Doctor

(10) Patent No.: US 10,791,888 B1
(45) Date of Patent: Oct. 6, 2020

(54) AUTOMATIC TOILET SEAT AND LID ASSEMBLY

(71) Applicant: Dilip Doctor, Sands Point, NY (US)

(72) Inventor: Dilip Doctor, Sands Point, NY (US)

( * ) Notice: Subject to any disclaimer, the term of this patent is extended or adjusted under 35 U.S.C. 154(b) by 8 days.

(21) Appl. No.: 16/239,700

(22) Filed: Jan. 4, 2019

(51) Int. Cl.
*A47K 13/10* (2006.01)
*A47K 13/12* (2006.01)

(52) U.S. Cl.
CPC ..... *A47K 13/10* (2013.01); *A47K 13/12* (2013.01)

(58) Field of Classification Search
USPC ..... 4/246.1, 246.3
See application file for complete search history.

(56) References Cited

U.S. PATENT DOCUMENTS 5,437,063 A * 8/1995 Cotham ..... A47K 13/10 4/241
5,504,947 A * 4/1996 Robellop ..... A47K 13/10 4/246.1
5,867,843 A * 2/1999 Robello ..... A47K 13/10 4/246.1
7,293,297 B2 * 11/2007 Hayashi ..... A47K 13/10 4/246.1
7,788,741 B2 9/2010 Lohss
8,020,221 B2 * 9/2011 Borochov ..... A47K 13/10 220/262
8,117,684 B1 * 2/2012 Strapp ..... A47K 13/10 4/246.1
8,640,268 B2 2/2014 Shek
8,739,321 B2 6/2014 Trout
8,910,320 B2 12/2014 Stauber et al.
2009/0113611 A1 * 5/2009 Jarjour ..... A47K 13/10 4/246.3
2011/0035866 A1 * 2/2011 Ricca ..... A47K 13/10 4/246.3
2011/0289666 A1 * 12/2011 Owen, Jr. ..... A47K 13/10 4/246.3
2012/0272442 A1 * 11/2012 Chamanara ..... A47K 13/10 4/246.3
2012/0272443 A1 * 11/2012 Chamanara ..... A47K 13/10 4/246.3
2012/0317709 A1 * 12/2012 Oates ..... E03D 5/105 4/313
2013/0263369 A1 * 10/2013 Embler ..... A47K 13/105 4/246.3
2017/0058500 A1 * 3/2017 Garrels ..... G08B 5/36
2018/0360277 A1 * 12/2018 Henderson ..... A47K 13/10

* cited by examiner

*Primary Examiner* — Lori L Baker
(74) *Attorney, Agent, or Firm* — Sanchelima & Associates, P.A.; Christian Sanchelima; Jesus Sanchelima

(57) ABSTRACT

An automatic toilet seat and lid assembly for raising or lowering a toilet lid or a seat includes a base body. A seat and a toilet lid are hingedly coupled to the base body. The automatic toilet seat and lid assembly also includes a proximity sensor provided at the base body. The proximity sensor is configured to detect the presence of a user within a predetermined distance. The automatic toilet seat and lid assembly further includes a microcontroller communicatively coupled to the proximity sensor. Additionally, a motor is communicatively coupled to the microcontroller and a lever is operatively coupled to the motor and the seat and the toilet lid. The proximity sensor detects the presence of the user within the predetermined distance and transmits a signal to the microcontroller. The microcontroller instructs the motor to operate the lever to raise the toilet lid or the seat or both.

6 Claims, 7 Drawing Sheets

AUTOMATIC TOILET SEAT AND LID ASSEMBLY

BACKGROUND OF THE INVENTION

1. Field of the Invention

The present disclosure generally relates to devices used for operating toilet seat or toilet lid or both automatically. More specifically, the present disclosure relates to an automatic toilet seat and lid assembly that is touch free, which can be automatically activated for raising and lowering of the seat and the lid for toilets.

2. Description of the Related Art

It is known that toilets such as flush toilets are commonly used in houses, retail stores, offices and so on. As known, the flush toilets comprise a base body, a hinged seat and a toilet lid for closing the toilet. Typically, the seat and the toilet lid are closed when the toilet is not used. For example, if the user of the toilet was male and had to urinate, the user of the toilet would lift both the toilet lid and the toilet seat (or simply the toilet seat if no toilet lid was present) to expose the basin or bowl of the toilet, thereby minimizing the contact of urine with the toilet seat. Alternatively, if the user is female, or if the user is male and had to sit on the toilet seat, only the toilet lid would be required to be manipulated, thereby leaving the toilet seat for sitting thereon. In other cases, the toilet seat may be in a raised position, and it may be necessary to manipulate the toilet seat downwardly so as to be able to sit on the toilet seat or to close the seat and/or the lid.

While raising or lowering the toilet seat and toilet lid manually, users' hands may touch fecal matter or the urination may fall on the seat, which will make it hard for the user or subsequent users to use the toilet. As a result, the user may have to clean the seat and inner side of the toilet lid after use. Otherwise, the subsequent user of the toilet may have to clean the seat and inner side of the toilet lid before using. This may pose several hygiene and health issues to the users.

Therefore, it is desirable to have minimum contact with the toilet from a personal hygiene standpoint, for health reasons both real and psychological, as well as simplified maintenance.

Several arrangements have been proposed in the past, which allow activating seat and lid raising and lowering automatically. An example of such arrangement is disclosed in a U.S. Pat. No. 8,640,268. In U.S. Pat. No. 8,640,268B2, an automatic toilet seat, including a base body, a toilet lid, a seat, a controller, a first lid lifter, a second lid lifter, a first sensor, a second sensor and a power supply is disclosed. The controller comprises a microprocessor. When the first sensor detects a human body, the microprocessor activates the second sensor and drives the toilet lid pivot to a lifting position. When the first sensor detects the human body again, the seat pivots to the lifting position. When the human body is away from the second sensor, the microprocessor would drive the toilet lid and the seat pivot to a closing position and deactivate the second sensor. Thus, the automatic toilet seat of the present invention provides a two-stage mechanism of an auto-lifting toilet lid.

Another example is disclosed in a U.S. Pat. No. 8,739,321. In U.S. Pat. No. 8,739,321B2, it is disclosed that an automatic toilet seat or lid moving apparatus includes a common toilet seat or lid having a torsion spring or other counterbalance means to counterbalance the weight of a toilet seat or lid, and a motor for raising and/or lowering the toilet seat or lid when desired. A control is utilized for signaling the motor to raise and/or lower the toilet seat or lid.

Yet another example is disclosed in a U.S. Pat. No. 8,910,320. In U.S. Pat. No. 8,910,320B2, an automated seat and/or lid assembly for a toilet is disclosed. The invention includes switch automation, wherein movement of a bowl attachment is initiated via a switch, and manual-urging automation, wherein a user initiates movement of a bowl attachment via manual urging.

Another example is disclosed in a U.S. Pat. No. 7,788,741. In U.S. Pat. No. 7,788,741B2, it is disclosed that a touch free, automatic seat and lid actuating system for toilets includes at least one of an advantageous drive mechanism for raising and lowering the seat and lid, a clutch mechanism enabling manual operation of the seat and the lid, and an attachment system for removably attaching the seat and the lid.

Although the devices discussed above are effective in activating seat and lid raising and lowering automatically, they have few problems. For instance, they need to be manually activated either by pressing a button or switch. Further, they have complex mechanism to raise or lower the toilet seat and toilet lid. Furthermore, none of the arrangements have the aesthetic appeal, simplicity, robustness, and ergonomic features necessary to make a commercially marketable product.

Other documents describing the closest subject matter provide for a number of more or less complicated features that fail to solve the problem in an efficient and economical way. None of these patents suggest the novel features of the present invention. Specifically, none of the disclosures in the art disclose an automatic toilet seat and lid assembly that can be used to raise or lower a toilet lid or seat or both when the user comes in proximity, or using a button provided on a wall or at the bottom of the base body of the toilet.

Therefore, there is a need to provide an automatic toilet seat and lid assembly that is touch free, which can be automatically activated for raising and lowering of the seat and the lid for toilets.

SUMMARY OF THE INVENTION

It is one of the main objects of the present invention to provide an automatic toilet seat and lid assembly and that avoids the drawbacks of the prior art.

It is one object of the present invention to provide an automatic toilet seat and lid assembly that can be used to raise or lower a toilet lid or seat or both when the user comes in proximity, or using a button provided on a wall or at the bottom of the base body of the toilet.

It is one object of the present invention to provide an automatic toilet seat and lid assembly for raising or lowering a toilet lid or a seat. The automatic toilet seat and lid assembly comprises a base body, a seat hingedly coupled to the base body and a toilet lid hingedly coupled to the base body. The automatic toilet seat and lid assembly comprises a proximity sensor provided at the base body. The proximity sensor is configured to detect presence of a user within a predetermined distance. The automatic toilet seat and lid assembly further comprises a microcontroller communicatively coupled to the proximity sensor, a motor communicatively coupled to the microcontroller and a lever operatively coupled to the motor and the seat and the toilet lid. The toilet lid and the seat are lowered onto the base body. The proximity sensor detects the presence of the user within the predetermined distance and transmits a signal to the microcontroller. The microcontroller instructs the motor to operate the lever to raise the toilet lid or the seat or both.

It is another object of the present invention to provide an automatic toilet seat and lid assembly for raising or lowering a toilet lid or a seat. The automatic toilet seat and lid assembly comprises a base body, a seat hingedly coupled to the base body and a toilet lid hingedly coupled to the base body. Further, the automatic toilet seat and lid assembly comprises a lever operatively coupled to the toilet lid and the seat, a motor operatively coupled to the lever and an actuator operatively coupled to the motor via a cable. The actuator is actuated to operate the motor to raise or lower the toilet lid or the seat or both.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

The following detailed description is intended to provide example implementations to one of ordinary skill in the art, and is not intended to limit the invention to the explicit disclosure, as one or ordinary skill in the art will understand that variations can be substituted that are within the scope of the invention as described.

The present disclosure discloses an automatic toilet seat and lid assembly for raising or lowering a toilet lid or a seat. The automatic toilet seat and lid assembly comprises a base body, a seat hingedly coupled to the base body and a toilet lid hingedly coupled to the base body. The automatic toilet seat and lid assembly comprises a proximity sensor provided at the base body. The proximity sensor is configured to detect presence of a user within a predetermined distance. The automatic toilet seat and lid assembly further comprises a microcontroller communicatively coupled to the proximity sensor, a motor communicatively coupled to microcontroller and a lever operatively coupled to the motor and the seat and the toilet lid. The toilet lid and the seat are lowered onto the base body. The proximity sensor detects the presence of the user within the predetermined distance and transmits a signal to the microcontroller. The microcontroller instructs the motor to operate the lever to raise the toilet lid or the seat or both.

In one embodiment, the automatic toilet seat and lid assembly comprises an actuator to operate the motor to raise or lower the toilet lid or the seat or both.

Various features and embodiments of an automatic toilet seat and lid assembly are explained in conjunction with the description of FIGS. 1-7.

Figure 1:
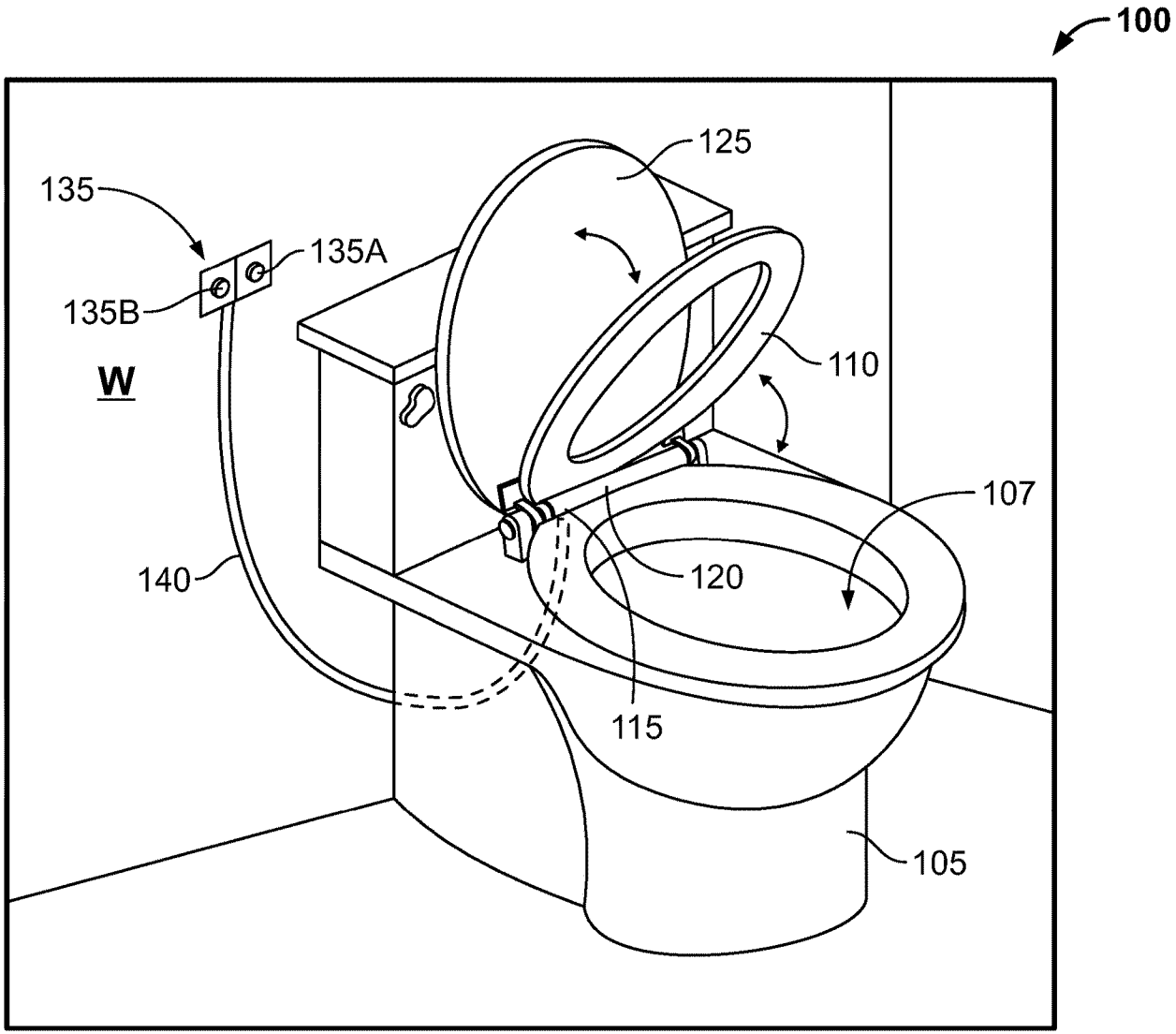
FIG. 1 illustrates a perspective view of an automatic toilet seat and lid assembly 100, in accordance with one embodiment of the present disclosure.

Referring to FIG. 1, a perspective view of an automatic toilet seat and lid assembly 100 is shown, in accordance with one embodiment of the present disclosure. The automatic toilet seat and lid assembly 100 comprises a base body 105 with a bowl 107. Further, the automatic toilet seat and lid assembly 100 comprises a seat 110 coupled to the base body 105 using a hinge 115 via a connecting rod 120. Further, the automatic toilet seat and lid assembly 100 comprises a toilet lid 125 coupled to the base body using the hinge 115 via the connecting rod 120.

Further, the automatic toilet seat and lid assembly 100 comprises at least one actuator 135 provided at a wall W. The at least one actuator 135 may indicate a button or switch or a toggle. In one example, more than one actuator 135 may be provided. For instance, a first actuator 135A may be provided to operate the toilet lid 125. Further, a second actuator 135B may be provided to operate the seat 110. In order to operate the toilet lid 125 and the seat 110, the first actuator 135A, and the second actuator 135B may be coupled to the toilet lid 125 and the seat 110, respectively via a cable 140.

In order to lift the toilet lid 125, a user may press the actuator 135. For instance, the user may press the first actuator 135A to raise the toilet lid 125. When the first actuator 135A is pressed, the cable 140 may pull the connecting rod 120 with the help of the hinge 115 so that the toilet lid 125 is raised.

Similarly, the user may press the second actuator 135B to raise/lift the seat 110. When the second actuator 135B is pressed, the cable 140 may pull the connecting rod 120 with the help of the hinge 115 so that the seat 110 is raised.

After using the toilet, the user may long press the second actuator 135B to lower the seat 110. Subsequently, the user may long press the first actuator 135A to lower the toilet lid 125 to cover the bowl 107. It should be obvious to a person skilled in the art to configure the single press or long press or double press to operate the cable 140 such that the seat 110, the toilet lid 125 or both are raised or lowered either independently or concurrently.

Figure 2:
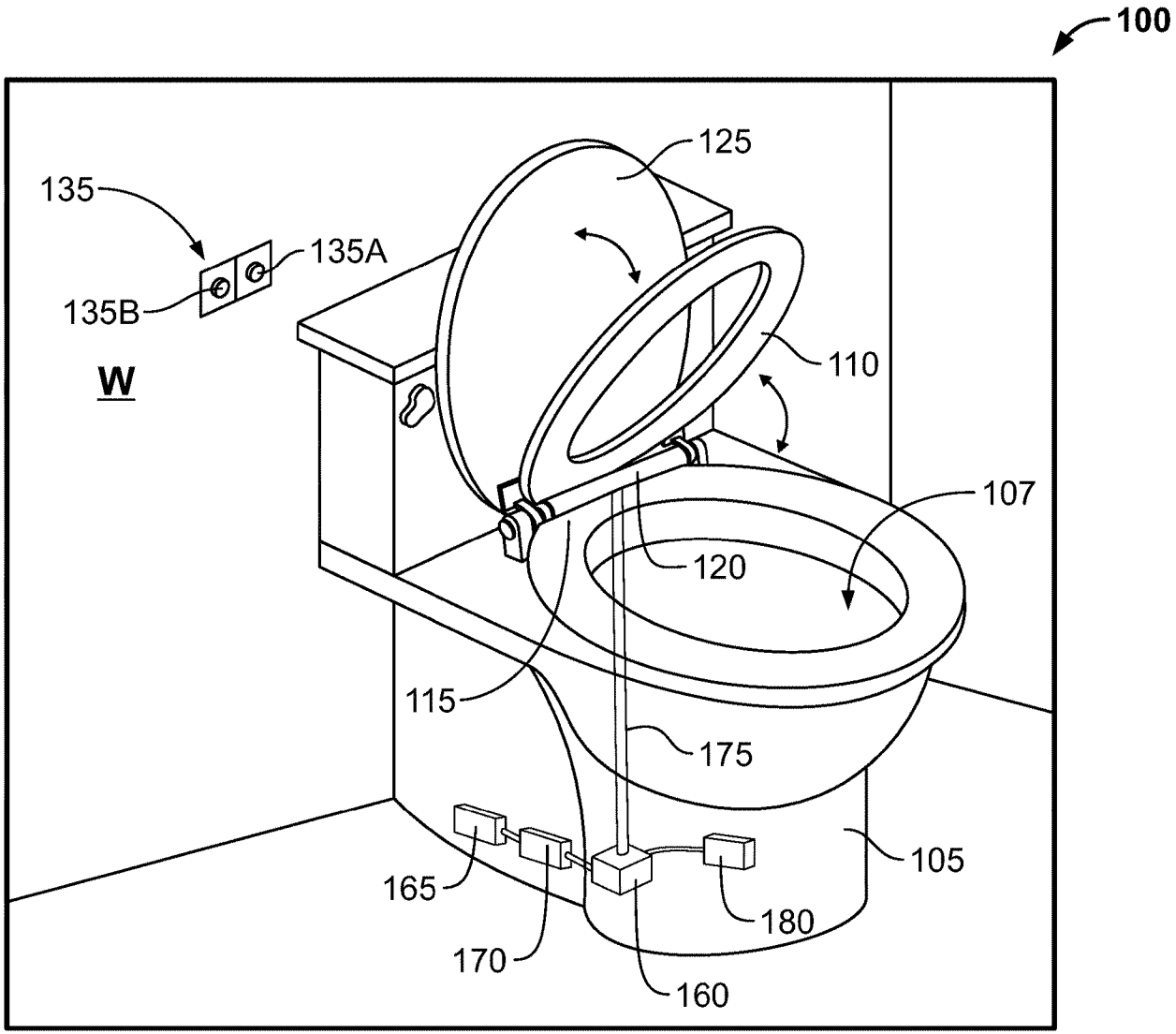
FIG. 2 illustrates the automatic toilet seat and lid assembly 100 comprising a motor 160 for operating a toilet lid 125 and a seat 110, in accordance with one embodiment of the present disclosure.

In another embodiment, the automatic toilet seat and lid assembly 100 may be operated with the help of a motor 160, as shown in FIG. 2. In the current embodiment, the automatic toilet seat and lid assembly 100 comprises a transceiver 165, a microcontroller 170, a lever 175 and a battery 180. In order to use the automatic toilet seat and lid assembly 100 for raising or lowering the seat 110 or the toilet lid 125, a user may press the actuator 135 as explained above.

Figure 3:
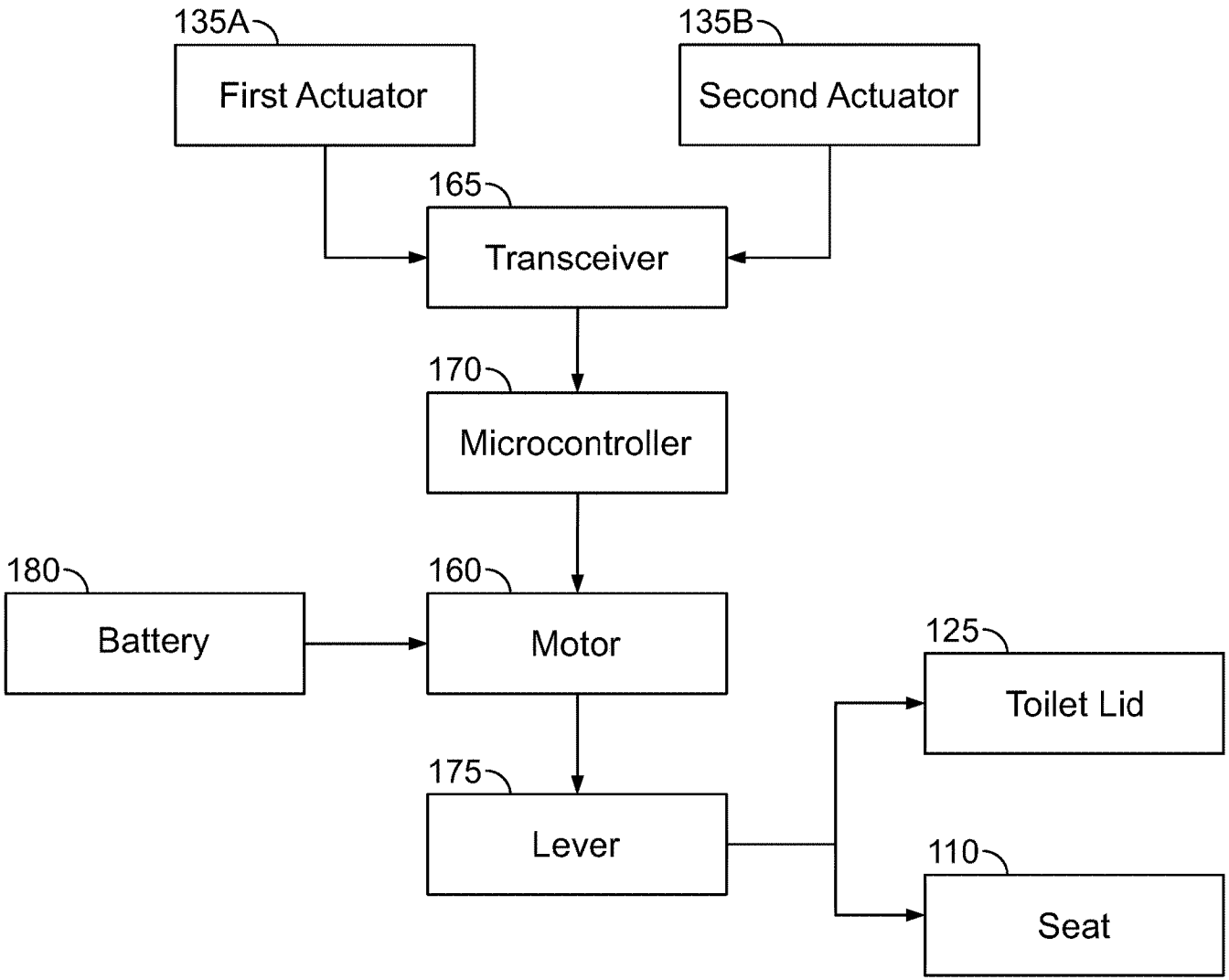
FIG. 3 illustrates operation flow of the automatic toilet seat and lid assembly 100, in accordance with one embodiment of the present disclosure.
Figure 4:
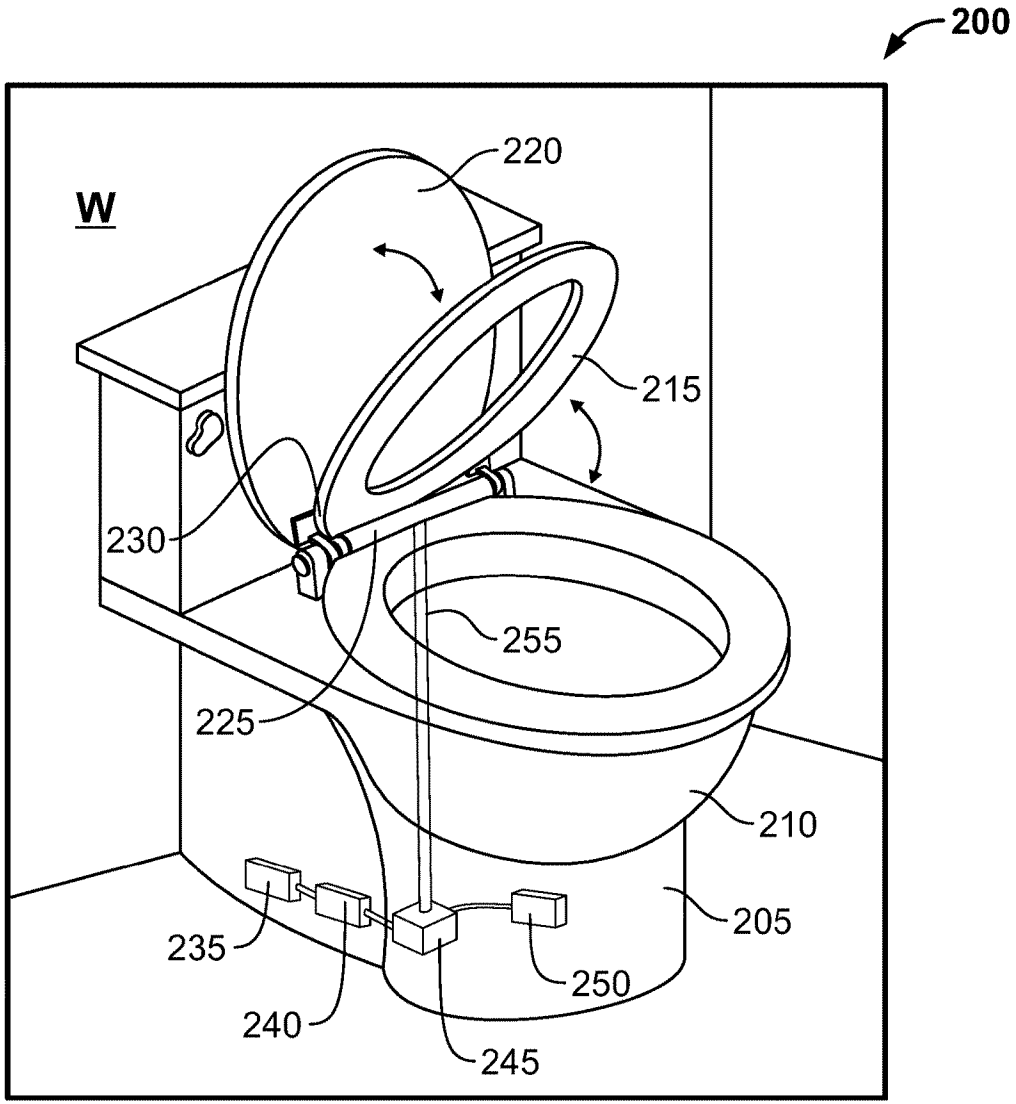
FIG. 4 illustrates a perspective view of an automatic toilet seat and lid assembly 200, in accordance with another embodiment of the present disclosure.
Figure 5:
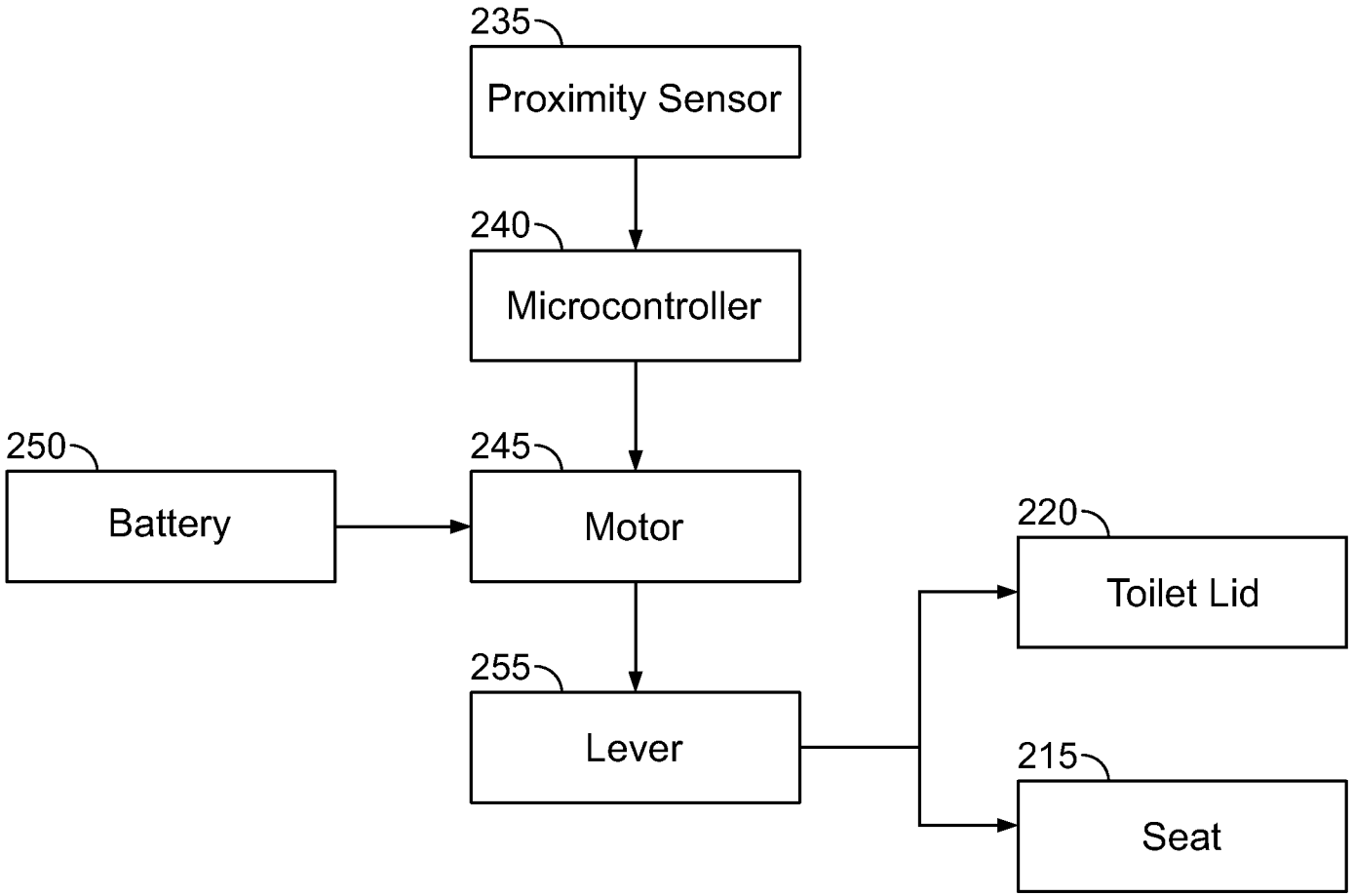
FIG. 5 illustrates operation flow of the automatic toilet seat and lid assembly 200, in accordance with one embodiment of the present disclosure.

Referring to FIG. 3, operation of the automatic toilet seat and lid assembly 100 is explained in conjunction with FIG. 2, in accordance with one embodiment of the present disclosure. When the actuator 135 is pressed, the transceiver 165 receives a signal indicating to raise or lower the seat 110 or the toilet lid 125 or both, either independently or concurrently. After receiving the signal, the transceiver 165 may send the signal to the microcontroller 170. Subsequently, the microcontroller 170 employs the motor 160 to engage the lever 175 such that the lever 175 engages the hinge 115 and the connecting rod 120 to raise or lower the seat 110, or the toilet lid 125 or both. It should be understood that the motor 160 draws power from the battery 180. In one example, the battery 180 may include a rechargeable battery or may be powered from a power source (not shown).

In another embodiment, sensors such as a proximity sensor or presence sensor may be used to operate the automatic toilet seat and lid assembly. Now referring to FIG. 4, an automatic toilet seat and lid assembly 200 using sensors to detect presence of a user in proximity to the toilet in order to operate the toiler lid and the seat is explained. The automatic toilet seat and lid assembly 200 comprises a base body 205, a bowl 210, a seat 215 and a toilet lid 220. As specified above, the seat 210 is coupled to the base body 110 using a hinge 225 via a connecting rod 230. Further, the toilet lid 220 is coupled to the base body 205 using the hinge 225 via the connecting rod 230. In the current embodiment, the automatic toilet seat and lid assembly 200 comprises a proximity sensor 235 capable of detecting presence of the user in proximity to the base body 205. In one example, the proximity sensor 235 is configured to detect presence of the user within a predetermined distance e.g., one meter of radius from the base body 205. Further, the automatic toilet seat and lid assembly 200 comprises a microcontroller 240, a motor 245, a battery 250, a lever 255 coupled to the motor 240 and the connecting rod 230.

It should be understood that the microcontroller 240 is communicatively coupled to the proximity sensor 235. Further, the motor 245 is communicatively coupled to the microcontroller 240. Further, the motor 245 is coupled to the lever 255. Furthermore, the motor 245 is coupled to the battery 250 for receiving power.

When the toilet is not being used, the seat 215 and the toilet lid 220 may be lowered i.e., closed. Now referring to FIG. 5, the process flow of operating the automatic toilet seat and lid assembly 200 is explained in conjunction with FIG. 4. When the user comes in proximity to the base body 205, the proximity sensor 235 may detect the presence of the user and send a signal to the microcontroller 240. Subsequently, the microcontroller 240 instructs the motor 245 to operate the lever 255. When the lever 255 is operated, the lever 255 pulls the toilet lid 220 and the seat 215 such that the toilet lid 220 and the seat 215 are raised. After use, the user may walk or move away from the base body 205. When the proximity sensor 235 detects that the user is not in proximity to the base body 205 for a predetermine time e.g., one minute, then the proximity sensor 235 may signal the microcontroller 240. Subsequently, the microcontroller 240 may instruct the motor 245 to operate the lever 255 in order to lower the seat 215 or the toilet lid 220 or both.

Figure 6:
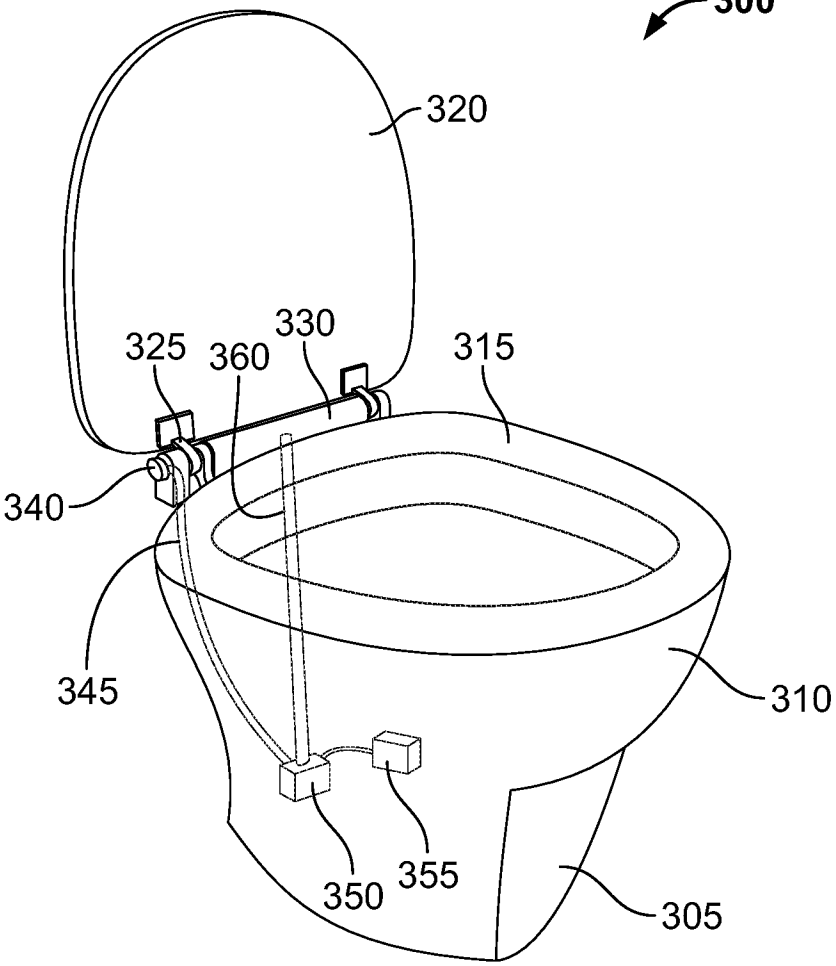
FIG. 6 illustrates a perspective view of an automatic toilet seat and lid assembly 300 in which an actuator 340 is provided at the base body 305, in accordance with another embodiment of the present disclosure.

Referring to FIG. 6, an automatic toilet seat and lid assembly 300 in accordance with another embodiment of the present disclosure is shown. The automatic toilet seat and lid assembly 300 comprises a base body 305, a bowl 310, a seat 315 and a toilet lid 320 is shown. As specified above, the seat 310 is coupled to the base body 305 using a hinge 325 via a connecting rod 330. Further, the toilet lid 320 is coupled to the base body 305 using the hinge 325 via the connecting rod 330. In the current embodiment, the automatic toilet seat and lid assembly 300 comprises an actuator 340 coupled to the hinge 325.

Further, the toilet seat and lid assembly 300 comprises a cable 345, used to couple the actuator 340 to a motor 350. Further, the toilet seat and lid assembly 300 comprises a battery 355 to power the motor 350. Further, the toilet seat and lid assembly 300 comprises a lever 360 coupled to the motor 350, the hinge 325 and the connecting rod 330.

In order to lift the toilet lid 320, a user may press the actuator 340 with his hand. For instance, the user may single press the actuator 340 to raise the toilet lid 320. When the actuator 340 is pressed, the cable 345 may pull the hinge 325 so that the toilet lid 320 is raised.

Similarly, the user may double press the actuator 340 to raise/lift the seat 315. When the actuator 340 is pressed, the cable 345 may pull the hinge 325 so that the seat 315 is raised.

After using the toilet, the user may long press the actuator 340 to lower the seat 315 or the toilet lid 320 or both.

Figure 7:
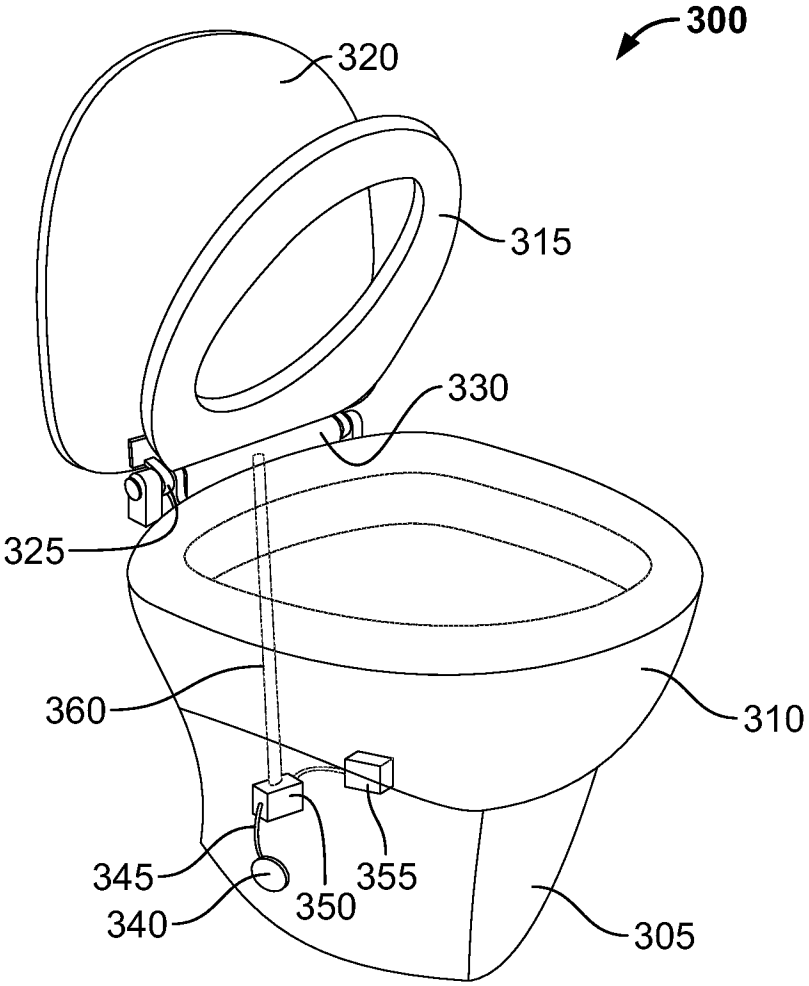
FIG. 7 illustrates a perspective view of the automatic toilet seat and lid assembly 300 in which the actuator 340 is provided at bottom of the base body 305, in accordance with another embodiment of the present disclosure.

In another embodiment, the actuator 340 may be provided at the bottom of the base body 305, as shown in FIG. 7. When the toilet is not being used, the seat 215 and the toilet lid 220 may be lowered i.e., closed. When the user wishes to use the toilet, he may press the actuator 340 with his leg. When pressed, the actuator 340 may engage the motor 350 with the help of the cable 345. Subsequently, the motor 350 may engage the lever 360 to pull the hinge 325 so that the toilet lid 320 or the seat 115 or both are raised.

After use, the user may release his leg from the actuator 340 and the toilet lid 320 or the seat 115 may be lowered for closing the bowl 210.

Based on the above, it is evident that the automatic toilet seat and lid assembly may be used to raise or lower the seat or toilet lid or both without touching the toilet. As a result, the user can keep away from the toilet and be clean when using the toilet.

Further, the components such as motors, sensors, battery, and cables are all placed inside the base body so that normal operation of the toilet is not hindered. Further, the automatic toilet seat and lid assembly is simple to use. The automatic toilet seat and lid assembly can be activated with a press of the actuator provided on the wall or at the hinge or on the base body. In addition, the automatic toilet seat and lid assembly may also be used with the help of the proximity sensor such that the automatic toilet seat and lid assembly can be used without touching anything.

The components may be manufactured from metal or plastic or any other suitable materials. With the wall-mounted actuator, the user may not have to touch or go near the toilet to lift or operate the mechanism to raise or lower the toilet lid or seat. As explained above, the toilet lid or the seat may be raised or lowered with the help of the actuator or using the sensor such as a proximity sensor.

It is understood that the automatic toilet seat and lid assembly allows the use of toilet without having to touch or handle the toilet lid or seat. As such, the automatic toilet seat and lid assembly would offer users a hygienic alternative to using the toilet lid and the seat. Thus, the automatic toilet seat and lid assembly protects the users from coming into direct contact with the germs and bacteria that are often found on the toilet.

With respect to the above description, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An automatic toilet seat and lid assembly, comprising:

a base body;

a seat hingedly coupled to the base body;

a toilet lid hingedly coupled to the base body;

a set of hinges which receive said seat and said toilet lid joined together through a connecting rod;

a lever having a top end and a bottom end, said lever positioned in a vertical configuration within said base body, said top end of said lever being coupled to said connecting rod and said set of hinges;

a motor operatively coupled to a bottom end of the lever, a proximity sensor coupled to a microcontroller further coupled to said motor; and an actuator operatively coupled to the motor via a cable, wherein the actuator is actuated to operate the motor to raise or lower the toilet lid or the seat or both.

2. The automatic toilet seat and lid assembly of claim 1, further comprises a battery coupled to the motor for powering the motor.

3. The automatic toilet seat and lid assembly of claim 1, wherein the actuator is located on a wall.

4. The automatic toilet seat and lid assembly of claim 1, wherein the actuator is located on a hinge provided at the base body.

5. The automatic toilet seat and lid assembly of claim 1, wherein the actuator is located at an outer surface of the bottom of the base body.

6. An automatic toilet seat and lid assembly, comprising:

a) a base body;

b) a seat hingedly mounted to said base body;

c) a toilet lid hingedly mounted to said base body;

d) a set of hinges which receive said seat and said toilet lid joined together through a connecting rod;

e) a wall including a first actuator and a second actuator, wherein said first actuator and said second actuator are circular buttons, wherein said first actuator and said second actuator are coupled to said toilet lid and said seat through a cable, wherein said first actuator controls said toilet lid, wherein said second actuator controls said seat, wherein said cable pulls said connecting rod and said hinge to raise said toilet lid when said first actuator is actuated, wherein said cable pulls said connecting rod and said hinge to raise said seat when said second actuator is actuated, wherein said toilet lid is lowered when a force is applied to said first actuator for an extended period of time, wherein said seat is lowered when a force is applied to said second actuator for an extended period of time.

* * * * *